United States Patent [19]

Greene et al.

[11] 3,993,286

[45] Nov. 23, 1976

[54] LOW PROFILE AIR JACK

[76] Inventors: Aubrey E. Greene, P.O. Box 26, Ellaville, Ga. 31806; James D. Anderson, 1000 Riverside Drive, NE., Gainsville, Ga. 30501

[22] Filed: Apr. 9, 1976

[21] Appl. No.: 675,445

[52] U.S. Cl. ..... 254/8 B; 254/127

[51] Int. Cl.[2] ..... B66F 3/24

[58] Field of Search ..... 254/2 R, 2 B, 2 C, 8 R, 254/8 B, 8 C, 9 R, 9 B, 9 C, 4 R, 4 B, 4 C, 124, 127, 128

[56] References Cited

UNITED STATES PATENTS

| | | | |
|---|---|---|---|
| 1,813,429 | 7/1931 | Sexton | 254/9 B |
| 2,476,380 | 7/1949 | Manke | 254/9 B |
| 2,489,056 | 11/1949 | Stewart | 254/9 B |
| 3,052,323 | 9/1962 | Hopfeld | 254/2 R |
| 3,168,284 | 2/1965 | Fisher | 254/124 |
| 3,664,635 | 5/1972 | Kincad | 254/8 B |
| 3,854,699 | 12/1974 | Garnett | 254/93 R |

*Primary Examiner*—Al Lawrence Smith
*Assistant Examiner*—Robert C. Watson
*Attorney, Agent, or Firm*—Edwin E. Greigg

[57] ABSTRACT

A low profile air jack for lifting vehicles is described, in which the force exerted by a horizontally disposed air cylinder and piston assembly on the lever arm of a lifting member pivoted to the jack frame causes the lifting member to rotate, so that its front end engages and lifts the vehicle. The piston shaft of the air cylinder is connected to the lever arm of the lifting member by a flexible chain and sprocket assembly which acts as a force-multiplying mechanism so that the force acting on the lever arm of the lifting member is approximately double the force which would be exerted if the piston shaft were directly connected to the lever arm by a rigid member. The two flexible chains are connected to a stabilizing bar, which is pivotably attached to the jack frame for both vertical and horizontal movement thereto, rather than directly to the frame, so that equal forces are applied to both chains during the lifting operation.

6 Claims, 6 Drawing Figures

LOW PROFILE AIR JACK

BACKGROUND OF THE INVENTION

This invention relates generally to pneumatically operated lifting devices and, more particularly, to low profile, portable air jacks used primarily in vehicle service stations, garages and repair shops to raise one end of a vehicle.

Such low profile jacks are widely used in auto shops because they can be readily moved about and properly positioned beneath a vehicle to be lifted regardless of the space available beneath the vehicle.

The use of pressurized air to operate such low profile jacks is very desirable, since most vehicle shops already have pressurized air systems.

It is also desirable that these low profile air jacks be of compact and simple construction, within the design limitations of the air pressure available, weight to be lifted, height to which lifted, and the low profile requirements.

In a known simple design of a low profile air jack, the vehicle is raised by a lifting member, which is pivotably attached to the top side of the jack frame, by application of a force against a downwardly-extending lever arm of this lifting member. The force required is produced by a horizontally disposed air cylinder mounted in the jack frame. The low profile requirement limits the length of the lever arm, the diameter of the air cylinder, and angular displacement of the lifting member, which, in turn, determines the length of the lifting member required to achieve the desired elevation of the vehicle.

The weight-lifting capability of such a low profile air jack is limited by the pressure of the available air supply. To increase the weight-lifting capability of this jack, the force applied to the lever arm can be increased above that which would be applied by a single, directly coupled air cylinder.

One method of increasing the force applied to the lever arm of the lifting member is disclosed in U.S. Pat. No. 3,664,635, issued May 23, 1972, to Mr. Gary L. Kincaid. This is achieved by the use of several air cylinders, whose pistons are attached to a common piston shaft, which, in turn, is directly coupled to the lever arm of the lifting member by a rigid connecting link.

SUMMARY OF THE INVENTION

It is a primary object of this invention to provide a low profile air jack, of simple and compact construction, which has a high weight-lifting capacity for the desired vertical displacement relative to the pressure of the operating air supply.

It is a specific object of this invention to provide a low profile air jack having a lifting arm and a sole single-piston air cylinder, which has a high weight-lifting capacity relative to the operating air pressure and piston size, obtained by using flexible power transmitting elements to increase the force exerted by the piston on the lifting arm.

It is a further object of the invention to provide a means of automatically equalizing the tension in each of these flexible power transmitting element during a lifting operation.

This low profile air jack is similar to the single cylinder air jack described above, in which a vehicle is raised by a lifting member, which is pivotably attached to the top portion of the jack frame, by the application of a force against a downwardly-projecting lever arm of the lifting member. When the lifting member is lowered, the vehicle-engaging portion is disposed above the front portion of the jack frame.

The operating air cylinder is horizontally disposed within the jack frame, with its piston shaft projecting towards the front end of the jack frame. The force required to rotate the lifting member upwards against the vehicle or other load to be lifted is transmitted from the piston shaft of the air cylinder to the lever points of the lifting member by a pair of flexible elements, such as a steel cable or a sprocket chain.

The lifting member has two axes projecting from each side which serve as the levering points at which force is applied. Also, the piston shaft has a horizontal crossbar fastened at its free end which carries an adjustable holding device on each side for the two flexible elements. Similarly, the front end of the jack frame carries a pivoted stabilizing bar having holding devices on each side for the flexible elements. On each side, the levering axis and the holding means of the crossbar and stabilizing bar lie approximately in the same vertical plane, so that the two flexible elements connected therebetween will be disposed in these vertical planes and will be approximately parallel to each other.

One end of each flexible element is connected to the adjustable holding means of the piston shaft crossbar, and its opposite end is connected to the stabilizing bar pivotably carried by the frame, with the medial portion of each flexible element extending over one of the levering axes.

To minimize wear on these axes and the flexible elements, these levering axes each carry a rotatable sheeve over which the flexible elements move. If the flexible elements are steel cables or the like, a simple pulley can be used. Where a sprocket chain is used as the flexible element, a matching sprocket gear is used.

When pressurized air is admitted to the air cylinder, the piston and piston shaft assembly, together with the end of each flexible member fastened to it, move linearly toward the front of the jack, causing the levering axes of the lifting member to move forward by rotating the lifting member about its pivotable connection to the frame, thus lifting a vehicle in contact with the engaging end of the lifting member.

Since only one end of the flexible element moves, the distance traversed by the levering axes will be only half that of the piston shaft, but the force applied through both ends of these flexible elements to that levering axes will be approximately double the force applied by the air cylinder alone, which is more specific object of this invention.

Since the stabilizer bar is freely pivotable in the plane in which the ends of the two flexible members attached to it act, this stabilizer bar assures equal tension in the two flexible elements during a lifting operation, a still further object of this invention.

This low profile air jack also has a safety catch for automatically locking the jack when it is fully raised. The piston shaft is provided with a transverse slot, into which a spring-loaded locking bar fits when the jack is fully extended, and the jack will not come down until the locking bar is manually released.

DESCRIPTION OF THE PREFERRED EMBODIMENT

Figure 1:
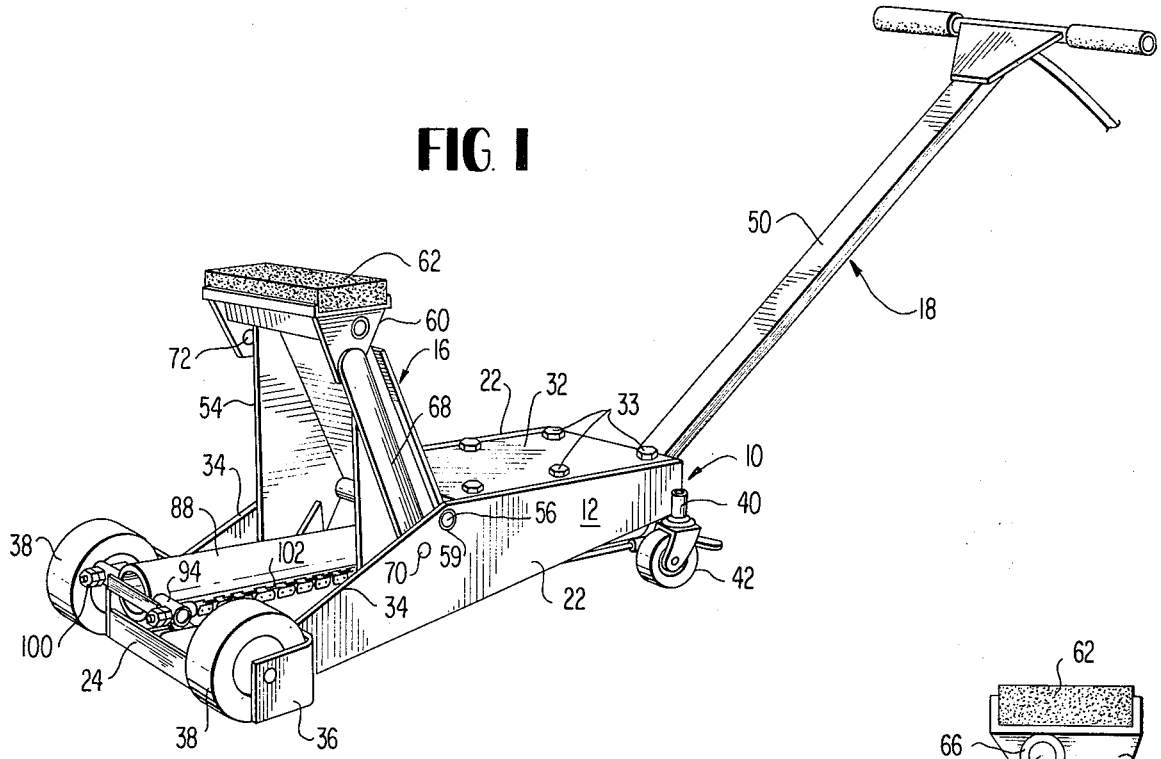
FIG. 1 is a perspective view of the air jack.
Figure 2:
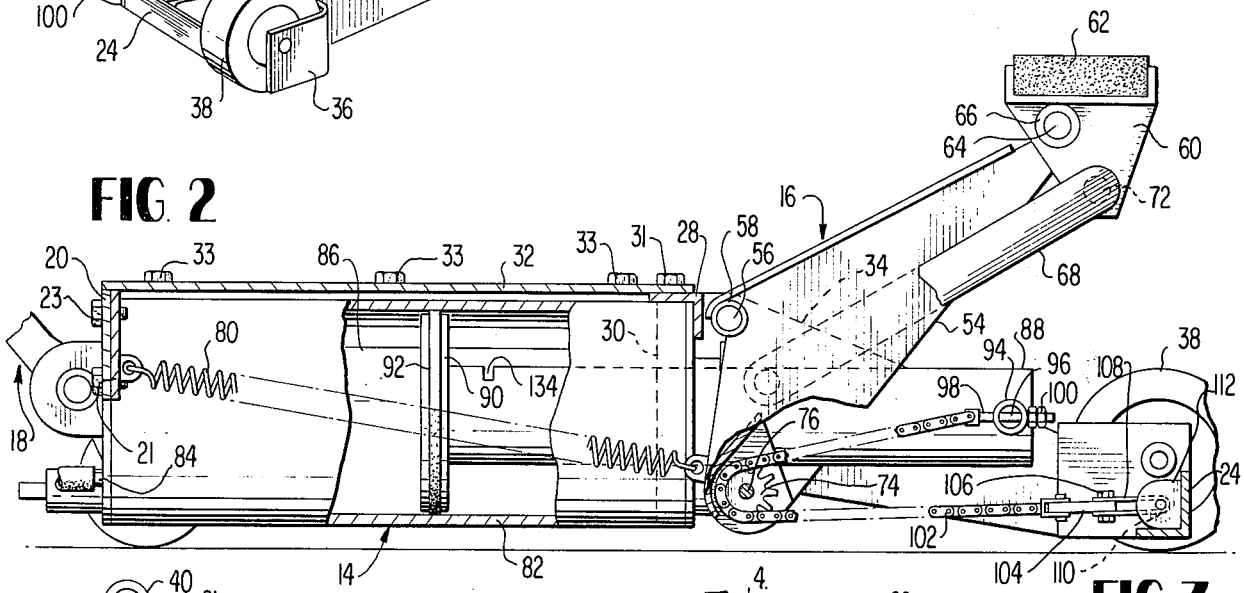
FIG. 2 is a partial vertical cross-sectional view of the air jack taken alongside one of the side frame members with portions of the air cylinder casing and lifting means remove to better illustrate elements contained therein.

Referring now to FIGS. 1 and 2, the low profile air jack 10 includes, as its primary components, a frame 12 which carries a horizontally disposed air cylinder assembly 14, means for engaging and lifting a vehicle broadly designated as 16, and a handle 18 which has one end pivotably connected to the rear end 20 of the cylinder assembly 14.

The frame 12 comprises a pair of spaced-apart side members 22 joined at its front end by a cross member 24 and at its rear end by the rear end housing 20 of the air cylinder assembly 14 which is bolted to vertical angle iron portions 21 of side members 22 by four bolts 23. The side members 22 are also joined at the front end of the air cylinder assembly 14 by an intermediate angle iron cross member 28 to which the cast iron front end housing 30 of the air cylinder assembly 14 is attached by a center bolt 31. The horizontal top edges of the side members 22 between the rear end and the cross member 38 include inward facing, welded-angle iron flanges (not shown) to which a top frame plate 32 is bolted by six bolts 33.

The portions of the side members 22 ahead of the intermediate cross member 28 have forwardly extending, downwardly inclined, upper edges 34 to approximately correspond to the inclination of the top surfaces of the engaging and lifting means 16 in its fully lowered position.

The ends of the front cross member 24 include U-shaped wheel mounting brackets 36, each carrying one of the front wheels 38. The lower back edges of the side members 22 both terminate at caster brackets 40, each bracket 40 carrying a rear caster wheel 42 pivotably mounted therein.

Figure 5:
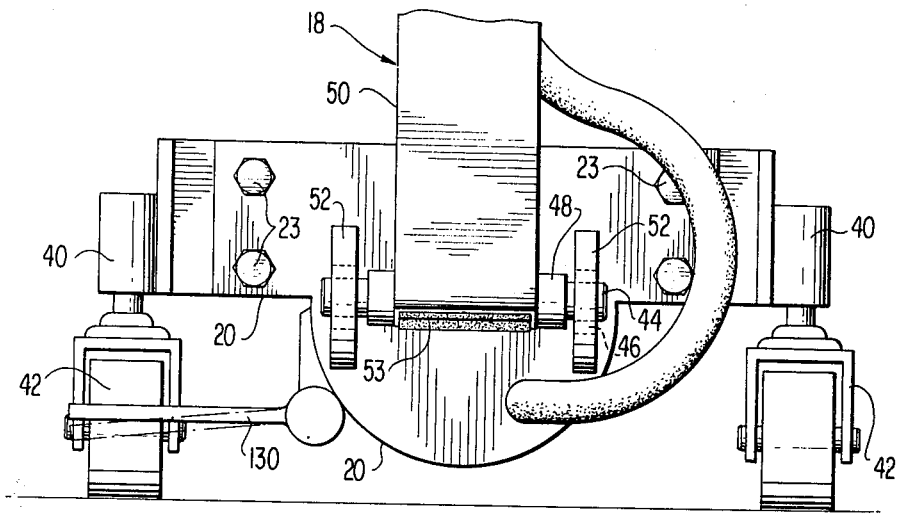
FIG. 5 is a partial rear vertical view of the air jack.

As best shown in FIG. 5, the handle 18 is pivotably attached to the rear end housing 20 of the air cylinder assembly 14 by a cross pin 44 which is held by a set screw (not shown) within a sleeve 48 that is secured to the top side of the rectangular metal tube shank 50 of the handle 18, the pin 44 being rotatably received by nylon bushing 46 carried by two spaced-apart brackets 52 secured to the rear end housing 20. The end of the tubular shank 50, adjacent and beneath the hinge pin sleeve 48, has a rudder insert 53 which sticks out of the end of the tubular shank 50 approximately ¼ inch, arranged so that when the handle is lowered, the rubber bumper 53 will strike the rear end housing 20 and prevent the handle 18 from striking the floor.

Again referring to FIGS. 1 and 2, the engaging and lifting means 16 comprises a lifting carriage 54 which is pivotally attached to the frame 12 at the normally uppermost rear portion of the lifting carriage 54 by means of a transversely extending hinge pin 56, which is journaled in bronze bushings 58 carried by the frame side members 22, and secured with snap rings 59 on each side.

At the normally forwardmost free end of the lifting carriage 54 there is provided a pad saddle 60 which holds a rubber pad 62 for engaging the vehicle to be lifted. This pad saddle 60 is pivotally attached to the lifting carriage 54 by a cross pin 64 which is journaled in bronze bushing 66 carried by the pad saddle 60.

The pad 62 is maintained level at all times by a pair of leveling links 68, pivotally attached to the pad saddle 60 at one end, and to the frame side members 22 at the other end. Side members 22 support a pair of transversely, oppositely disposed pivot pins 70 which carry the inner ends of the leveling links 68. The outer ends of the leveling links 68 carry a pair of oppositely disposed pivot pins 72, which ar journaled to the pad saddle 60.

At the normally rearmost, lower part of the lifting carriage 54 there is provided a pair of transversely, oppositely disposed sprocket gears 74, each of which is rotatably attached to the lifting carriage 54. The axes about which these sprockets 74 rotate, serve as levering points for a force applied to rotate the lifting carriage 54. The sprockets 74 are each mounted on a shaft 76 which is journaled in bearings 77 carried by the lifting carriage 54 and a bearing bracket 78 suitably attached to the carriage 54.

Also, a pair of transversely, oppositely disposed springs 80, each having one end attached to the lifting carriage 54 near the spockets 74 and an opposite end attached to the rear end portion 21 of the frame 12 is provided for exerting a force on the lifting carriage 54 to return and maintain it in its lowered position when the jack is not in use.

Figure 3:
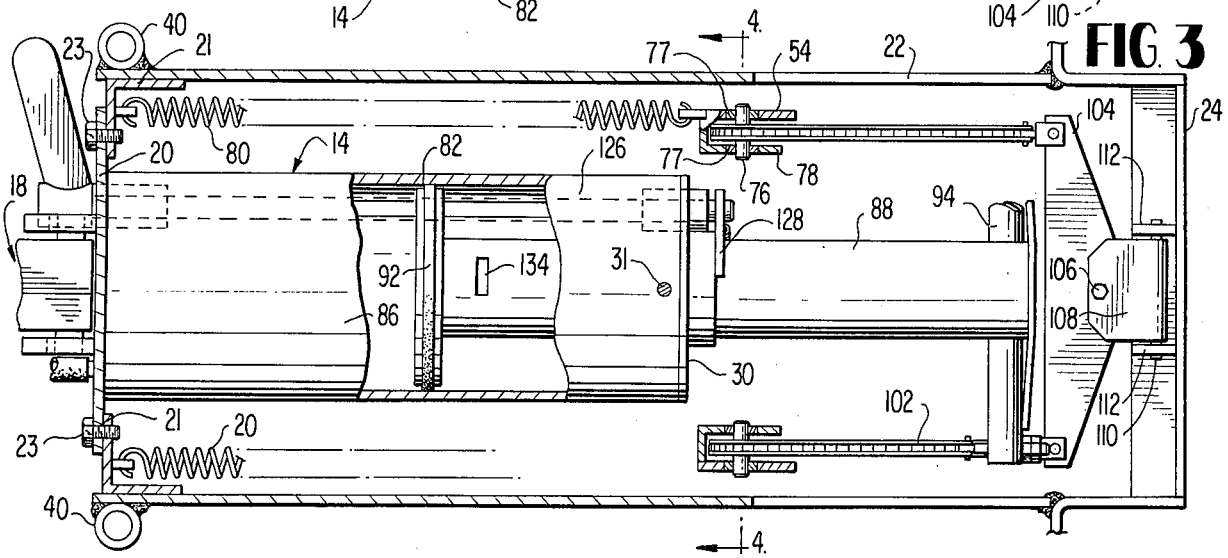
FIG. 3 is a partial horizontal cross-sectional view of the air taken alongside the top side of the air cylinder with portions of the air cylinder casing and lifting means removed.

As shown in FIGS. 2 and 3, the air cylinder assembly 14 comprises a steel cylinder 82 having a wall thickness of approximately 3/16 inch and an inside diameter of approximately 6, inch having a rear housing 20 containing an air hose connection 84 through which pressurized air is admitted to the piston chamber 86. A cast iron front housing 30, bolted to the cylinder 82, contains an opening therein to allow reciprocating motion of the piston shaft 88 therethrough. The piston 90 has a diameter of just under 6 inches and includes a rubber cup 92 to prevent air leakage.

The piston shaft 88 is a 2-¾inches steel tube welded to the piston 90 at its back end and carrying at its front end a horizontally disposed ¾inch diameter cross rod 94 having a diametric, horizontal hole 96 near each end of the cross rod 94 lying in approximately the same vertical plane as the corresponding sprocket 74. A threaded bolt 98 inserted in each of these holes 96 carries adjusting nuts 100 on its rear end.

The opposite end of each of the two sprocket chains 102 is fastened to the stabilizing bar 104 at a point in the same approximate vertical plane as the corresponding sprocket 74 and mounting bolt 98 with a median portion of each chain 10 passing around and in meshing contact with the corresponding sprocket 74. The stabilizer bar 104 is pivotally attached by a generally vertically disposed center bolt 106 to a U-shaped bracket 108 which, in turn, is pivotally attached to the frame cross member 24 by a horizontally disposed pivot pin 110 carried by spaced-apart brackets 112 fastened to the cross member 24.

Figure 6:
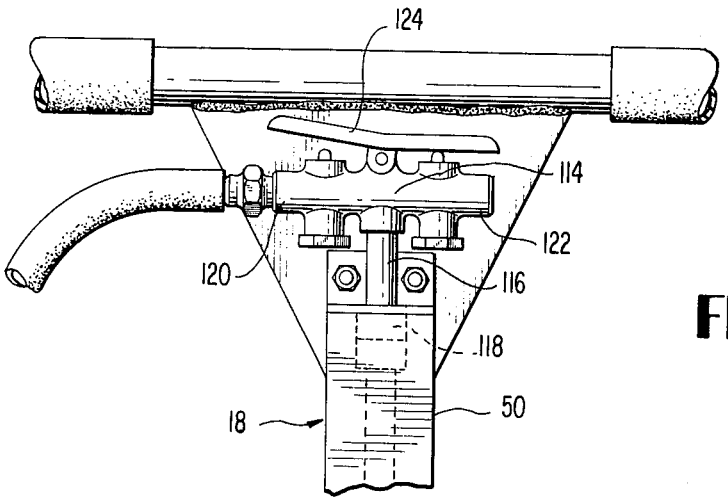
FIG. 6 is a detail of the underside of the jack handle end showing the three-way air valve for controlling air pressure in the air cylinder.

Pressurized air is admitted to the air cylinder assembly 14 through a commercially available three-way air valve 114 disposed at the free end of the handle 18 as shown in FIG. 6. An outlet 116 connected to the air cylinder assembly 14 by a flexible air hose 118 can be connected to either a pressurized air inlet 120 or to a vent outlet 122 to the atmosphere. The valve 114 has a pivoted operating lever 124. When one side of the lever 124 is depressed, pressurized air flows through the air hose 118 which is connected to the air hose connection 84 of the rear end housing 20, the hose 118 being contained within the rectagular tubular shank 50 for most of its length. When the opposite side of the lever 124 is depressed, the air hose 118 is connected to the outside through the valve outlet 122, thus reducing the pressure in the piston chamber 86 to atmospheric pressure.

Figure 4:
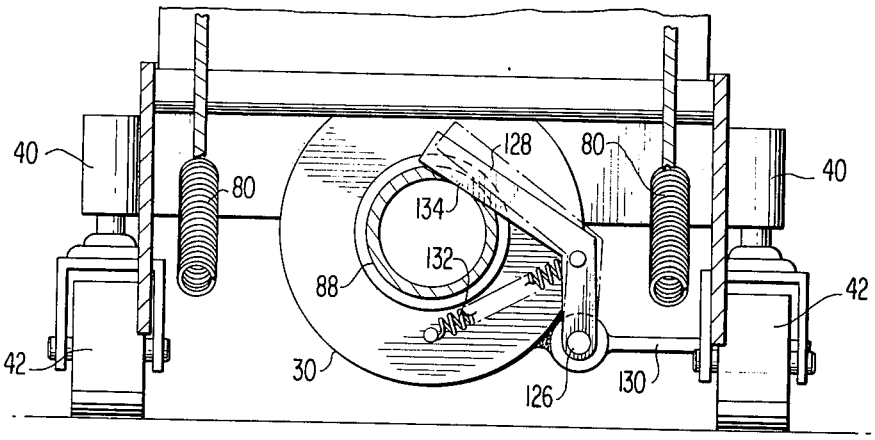
FIG. 4 is a partial vertical cross-sectional view of the air jack, taken along line 4—4 of FIG 3, alongside the jack position locking bar.

The air jack 10 has an automatic safety catch for locking the jack in its fully raised position, which is best shown in FIG. 4. A shaft 126, extending the length of the air cylinder 14 and rotatably mounted thereon, has a locking bar 128 fixedly attached to its front end, and a release handle 130 attached to its rear end. A spring 132 acts on the locking bar 128 and shaft 126 to hold the bar 128 against the piston shaft 88. When the jack 19 is fully raised, the piston shaft 88 is moved forward, allowing the locking bar 128 to be pulled by the spring 132 into a transverse milled slot 134 in the piston shaft 88, thus locking the lifting mechansim in the raised position. To release the locking bar 128, the release handle 130 at the rear of the jack 10 is depressed and the rotating shaft 126 moves the locking bar 128 out of the shaft 134.

What is claimed is:

1. A low profile air jack which comprises:

a frame;

a horizontally disposed air cylinder carried by said frame and having a pressure chamber therein;

a piston assembly slidably disposed within said air cylinder and having a portion extending beyond said cylinder towards a front end of said frame;

means for moving said piston assembly towards the front end of said frame which includes means for introducing pressurized air into said chamber, said pressurized air exerting a force against said piston assembly in a forward direction;

means for moving said piston assembly towards a rear end of said frame, which includes:

atmospheric venting means for said chamber to reduce air pressure therein, and spring means for exerting a rearward force in said piston assembly;

means for engaging and lifting a vehicle or other object, said engaging and lifting means being pivotable about a horizontal axis of said frame, said axis being above and orthogonal to the axis of symmetry of said air cylinder;

receiving means carried by said engaging and lifting means; and flexible means connected to said projecting portion of said piston assembly and to said frame, and extending over said receiving means, for acting on said receiving means to effect rotational movement of said engaging and lifting means, whereby said load is lifted when said piston assembly is moved in a forward direction.

2. A low profile air jack as described in claim 1, wherein said receiving means comprises a pair of sprockets, rotatable about a horizontal axis of said engaging and lifting means, and said flexible means comprises a pair of generally parallel sprocket chains, each engaging a different one of said pair of sprockets.

3. A low profile air jack as described in claim 2, wherein said projecting portion of said piston assembly includes a piston rod carrying a horizontal cross rod at its forward end, to which each chain is fastened, by a bolt having an adjusting nut for equalizing the lengths of said chains.

4. A low profile air jack as described in claim 2, wherein said frame includes a generally horizontally disposed stabilizer bar, to which each chain is fastened, said stabilizer bar being pivotably attached to the front end of said frame for limited rotatable movement in both a horizontal and vertical plane, to keep said chains equally tight during the lifting operation.

5. A low profile air jack as described in claim 1, which further comprises safety catch means for automatically locking said jack in its fully raised position, said locking means including:

said piston assembly, wherein said projecting portion is a piston rod defining a transverse milled slot which extends beyond said cylinder when said air jack is fully raised;

a shaft extending the length of said air cylinder and rotatably mounted thereon;

a locking bar fixedly attached to the front end of said shaft;

a release handle fixedly attached to the rear end of said shaft; and spring means acting on said locking bar and shaft to hold spring bar against said piston rod and in said slot when said jack is fully raised.

6. A low profile air jack as described in claim 1, wherein said engaging and lifting means comprises:

a lifting carriage pivotably attached to said frame;

a pad saddle holding a rubber pad for engaging said object to be lifted, which is pivotably attached to said lifting carriage; and a pair of stabilizing arms pivotably fastened to said pad saddle at one end and to said frame at an opposite end for maintaining said pad level at all times.

* * * * *